US008485633B2

(12) United States Patent
Ito et al.

(10) Patent No.: US 8,485,633 B2
(45) Date of Patent: Jul. 16, 2013

(54) DROPLET DETECTING DEVICE AND INKJET PRINTER

(75) Inventors: Kazumasa Ito, Aichi (JP); Hirotaka Hayashi, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 6 days.

(21) Appl. No.: 13/126,330

(22) PCT Filed: Jan. 6, 2010

(86) PCT No.: PCT/JP2010/050047
§ 371 (c)(1),
(2), (4) Date: Apr. 27, 2011

(87) PCT Pub. No.: WO2010/082516
PCT Pub. Date: Jul. 22, 2010

(65) Prior Publication Data

US 2011/0205283 A1 Aug. 25, 2011

(30) Foreign Application Priority Data

Jan. 16, 2009 (JP) ..... 2009-007822

(51) Int. Cl.
*B41J 29/393* (2006.01)

(52) U.S. Cl.
USPC ..... 347/19

(58) Field of Classification Search
None
See application file for complete search history.

(56) References Cited

U.S. PATENT DOCUMENTS 5,712,667 A 1/1998 Sato
6,305,777 B1 * 10/2001 Lee ..... 347/19
6,513,900 B2 2/2003 Endo et al.
6,550,885 B2 4/2003 Matsumoto et al.
6,641,246 B2 11/2003 Endo et al.
8,366,234 B2 * 2/2013 Ito et al. ..... 347/19
2005/0078138 A1 4/2005 Koyama
2010/0091063 A1 4/2010 Nagata

FOREIGN PATENT DOCUMENTS

CN 1590094 A 3/2005
JP 55-112223 U 8/1980
JP 07-089090 A 4/1995

(Continued)

OTHER PUBLICATIONS

English translation of Japanese Decision of Patent Grant issued in Japanese Patent Application No. 2009-007822 dated Mar. 13, 2012.
Japanese Decision of a Patent Grant, issued in Japanese Patent Application No. 2009-007822, dated Mar. 13, 2012.

(Continued)

*Primary Examiner* — Geoffrey Mruk
(74) *Attorney, Agent, or Firm* — McDermott Will & Emery LLP

(57) ABSTRACT

Provided is an ink detecting module (100) that detects the discharge state of a liquid droplet by receiving a light beam emitted to a flying path of the liquid droplet discharged from a nozzle row (103) of an inkjet printer, the ink detecting module including: a light emitting unit (104) that emits a light beam; a light receiving unit (105) that receives the emitted light beam; and a module base (108) that integrally supports the light emitting unit (104) and the light receiving unit (105), the module base (108) including: positioning pins (106, 107) that are engaged with the inkjet printer and determine the fastening position in the inkjet printer; and a fastening unit that is fastened to the inkjet printer, in which, in the state of being fastened to the inkjet printer, only the positioning pins (106, 107) and the fastening unit are in contact with the inkjet printer.

5 Claims, 3 Drawing Sheets

FOREIGN PATENT DOCUMENTS

| | | | |
|---|---|---|---|
| JP | 2001-063010 | A | 3/2001 |
| JP | 3509706 | | 3/2004 |
| JP | 2005-007809 | A | 1/2005 |
| WO | WO-2008/090800 | A1 | 7/2008 |

OTHER PUBLICATIONS

Chinese Office Action issued in Chinese Application No. 201080002989.X dated Apr. 3, 2013.

* cited by examiner

DROPLET DETECTING DEVICE AND INKJET PRINTER

RELATED APPLICATIONS

This application is the U.S. National Phase under 35 U.S.C. §371 of International Application No. PCT/JP2010/050047, filed on Jan. 6, 2010, which in turn claims the benefit of Japanese Application No. 2009-007822, filed on Jan. 16, 2009, the disclosures of which applications are incorporated by reference herein.

TECHNICAL FIELD

The present invention relates to a droplet detecting device and an inkjet printer.

BACKGROUND

Conventionally, there is disclosed an inkjet-type recording apparatus that performs optical position adjustment between a light emitting module and a light receiving module with respect to a base member (for example, see Patent Literature 1). In this inkjet-type recording apparatus, the light emitting module and the light receiving module are fixed to a casing as the base member by adjusting the optical axes thereof.

CITATION LIST

Patent Literature

Patent Literature 1: Japanese Patent Publication No. 3509706

SUMMARY

Technical Problem

However, in regard to the conventional inkjet-type recording apparatuses described as above, disclosed is a technique of fixing the light emitting module and the light receiving module to the casing as the base member by adjusting the optical axes thereof. However, there is no consideration of maintenance of the accuracy, the stability, and the like in the optical axis adjustment when the modules are mounted in the main body (printer) after the adjustment. Accordingly, there is a problem in that the accuracy changes in the state in which a droplet detecting device configured to be integrated with a module base by adjusting the optical axes thereof is fixed to the main body (printer), and the function of the optical axis adjustment is not stable.

Solution to Problem

The present invention is contrived in view of the above, and the object thereof is to allow a droplet detecting device, configured to be integrated with a module base by adjusting the optical axes of a light emitting unit and a light receiving unit used as detection modules, to function stably without variations in accuracy in the state of being fixed to a main body (printer).

According to an aspect of the present invention, provided is a droplet detecting device that detects a discharge state of a liquid droplet by receiving a light beam emitted to a flying path of the liquid droplet discharged from a nozzle of an inkjet printer, the droplet detecting device including: a light emitting unit that emits the light beam; a light receiving unit that receives the emitted light beam; and a detection unit that includes a base unit integrally supporting the light emitting unit and the light receiving unit, wherein the base unit includes: at least two positioning units that are engaged with the inkjet printer and determine the fastening position onto the inkjet printer; and a first fastening unit that is fastened to the inkjet printer, and wherein, in the state of being fastened to the inkjet printer, only the positioning units and the first fastening unit are in contact with the inkjet printer.

According to another aspect of the present invention, the first fastening unit may be arranged at an approximate center of the detection unit, or at a position close to the light receiving unit from the center.

According to still another aspect of the present invention, the base unit may further include a second fastening unit that is fastened to the inkjet printer through an elastic member.

According to still another aspect of the present invention, the light receiving unit may receive scattering light that is generated when the light beam collides with the liquid droplet, and the detection unit may detect the discharge state of the liquid droplet based on light intensity of the scattering light.

According to still another aspect of the present invention, provided is an inkjet printer in which the droplet detecting device described above may be built.

Advantageous Effects of Invention

According to the present invention, obtainable is an advantage of allowing a droplet detecting device, configured so as to be integrated with a module base by adjusting the optical axes of a light emitting unit and a light receiving unit used as detection modules, to function stably without variations in accuracy in the state of being fixed to a main body (printer).

DESCRIPTION OF EMBODIMENTS

Hereinafter, preferred embodiments of a droplet detecting device and an inkjet printer according to the present invention will be described in detail with reference to the accompanying drawings.

Embodiment

Figure 1:
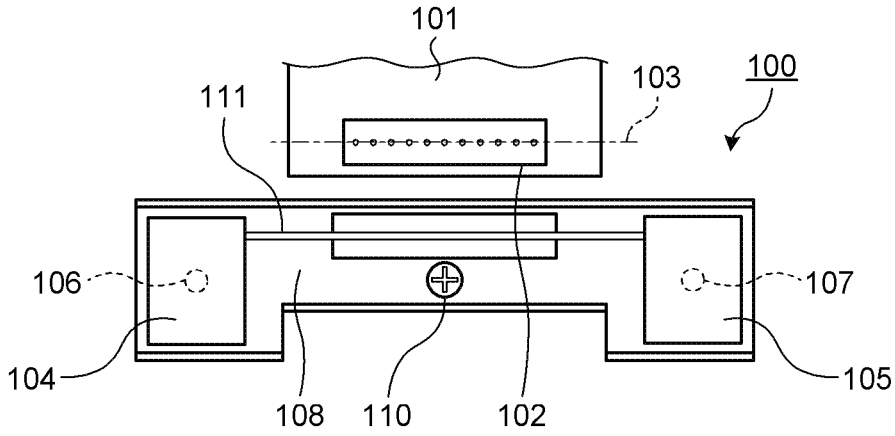
FIG. 1 is a plan view illustrating the configuration of a droplet detecting device according to this embodiment.
Figure 2:
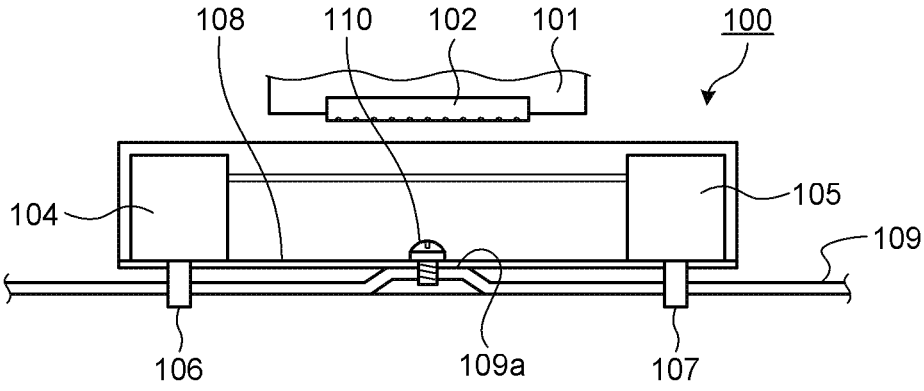
FIG. 2 is a side view illustrating the configuration of the droplet detecting device of FIG. 1.

FIG. 1 is a plan view illustrating the configuration of a droplet detecting device according to this embodiment, and FIG. 2 is a side view of FIG. 1. FIGS. 1 and 2 illustrate an example of the configuration of an inkjet printer in which an ink detecting module 100 is incorporated as a droplet detecting device. As shown in FIGS. 1 and 2, the inkjet printer includes a carriage 101, a recording head 102, a nozzle row 103, an ink detecting module 100, a mounting base 109, and a fastening member 110 including a screw and the like.

The ink detecting module 100 detects the discharge of liquid droplets by using a light emitting element and a light receiving element. The ink detecting module 100 includes a light emitting unit 104 having the light emitting element such as a laser diode, a light receiving unit 105 having the light receiving element such as a photodiode, and a module base 108 supporting the light emitting unit 104 and the light receiving unit 105. In the module base 108, positioning pins 106 and 107 are formed. The positioning pins 106 and 107 are pins that are used for determining the positions of the light emitting unit 104 side and the light receiving unit 105 side. A detection beam 111 is emitted from the light emitting unit 104 toward the light receiving unit 105.

The mounting base 109 is a base, on which the ink detecting module 100 is mounted, located on the inkjet printer main body side. The mounting base 109 includes a mounting face 109*a* having a convex face that gives a predetermined gap between the mounting base 109 and the ink detecting module 100 for screw fastening.

As illustrated in FIGS. 1 and 2, the light emitting unit 104 and the light receiving unit 105 are integrated with the module base 108 by being adjusted of the optical axes with respect to the positioning pins 106 and 107. Then, the module base 108 is arranged at a portion corresponding to the positioning pins 106 and 107 of the mounting base 109 and then is screw-fastened with a fastening member 110 to the mounting face 109*a* at one position.

As above, by configuring the light emitting unit 104 and the light receiving unit 105 so as to be integrated with the module base 108, the optical axis of the detection beam 111 is adjusted with respect to the positioning pins 106 and 107. At this time, the light emitting unit 104 encases the light emitting element and a driving circuit thereof. The light receiving unit 105 encases the light receiving element and a detection circuit thereof.

In addition, the module base 108 needs to have rigidity, taking deformation due to assembly or the like and the misalignment of the optical axis due to distortion into consideration. Particularly, regarding the mounting of the light emitting unit 104, there is likelihood that distortion occurs when the light emitting unit is mounted on the module base 108, distortion occurs when the optical axis is adjusted, distortion occurs when it is mounted on the main body, and the like. In order to avoid these problem, there may be considered a configuration of increasing the plate thickness of the module base 108 or a configuration using die casting or resin molding so as to improve the rigidity of the module base 108. However, when taking the rigidity into consideration, the shape is enlarged. Accordingly, when a tradeoff with the cost is considered, a chassis structure acquired by bending a metal plate or the like is preferable.

Next, a structure for minimizing the misalignment of the optical axis due to the mounting structure will be described. First, the mounting and the position determining structure of the ink detecting module 100 will be described. The detection beam 111 of a detection area that is located between the light emitting unit 104 and the light receiving unit 105 is positioned through adjustment of the optical axis, which is performed in advance, with respect to the positioning pins 106 and 107 of the module base 108. In consideration of the misalignment of the optical axis attributable to the occurrence of distortion of the module base 108 that is caused by the bias of the weight balance of the ink detecting module 100, the module base 108 is fastened to the mounting base 109 of the main body with the fastening member 110 that is disposed at an approximate center position of the ink detecting module 100. As is obvious, it is preferable that the adjustment of the optical axis of the ink detecting module 100 is adjusted through a similar fixing structure.

In addition, it is preferable to consider the area and the flatness of the mounting face 109*a* of the mounting base 109 of the main body for suppressing the occurrence of distortion at the time of the fastening to be minimal. In addition, units other than the fastening unit need to have a sufficient gap so as not to interfere with the ink detecting module 100. In a case where other fastening units are arranged so as to protect the ink detecting module 100 from an unpredicted external force applied to the ink detecting module 100, it is necessary to form a gap so as to prevent the interference by using a shoulder screw or the like.

Through the fastening as above, the detection beam 111 and the nozzle row 103 are parallel to each other. In addition, the status of ink discharging can be checked by moving the carriage 101 so as to allow the nozzle row 103 and the detection beam 111 to match with each other and to allow ink from the nozzle row 103 to sequentially collide with the detection beam 111.

Figure 3:
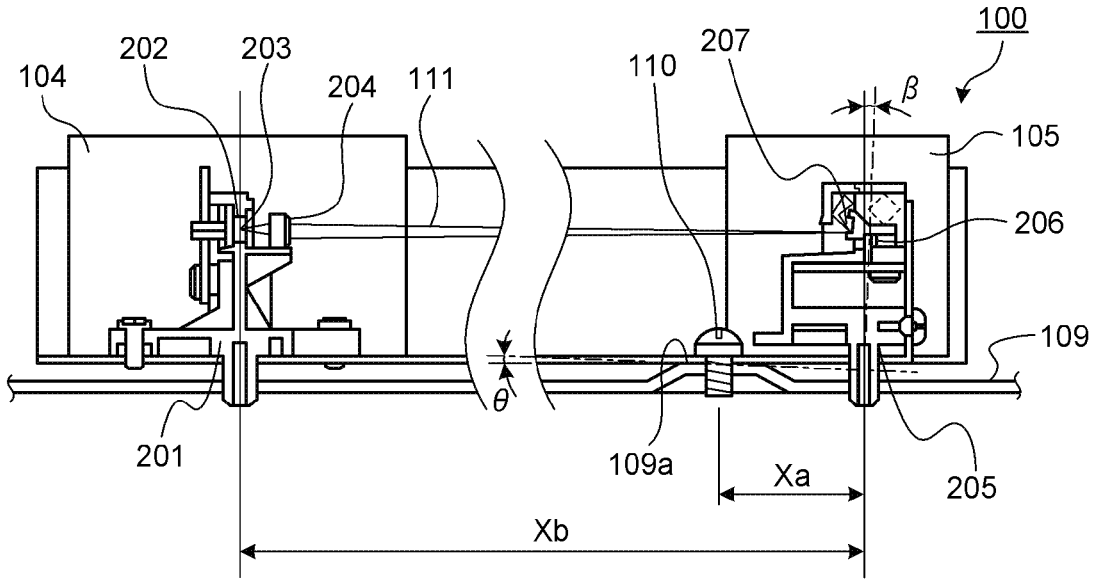
FIG. 3 is an explanatory diagram illustrating the configuration of a light emitting unit and a light receiving unit and illustrating an example in which a fastening member is disposed at one position on the light receiving unit side.

Next, the detection capability and the like based on the arrangement of the fastening member 110 in the above-described configuration will be described with reference to FIGS. 3 and 4. FIG. 3 is an explanatory diagram illustrating the configuration of the light emitting unit 104 and the light receiving unit 105 and illustrating an example in which the fastening member 110 is disposed at one position on the light receiving unit 105 side. As illustrated in FIG. 3, the light emitting unit 104 includes an LD block 201, a laser 202, a light emitting point 203, and a collimate lens 204. The light receiving unit 105 includes a PD block 205, a light receiving surface 206, and a reflection surface 207.

As illustrated in FIG. 3, the detection beam 111, which is diffused light whose light emitting point is the light emitting point 203 of the laser 202, is formed as an approximately parallel beam through the collimate lens 204. In this embodiment, in the state in which the detection beam 111 is detected, the adjustment of the optical axis and the focus detection are performed in such a manner that the beam waist of the detection beam 111 is positioned on the reflection surface 207 of the PD block 205. Then, treatment of stray light is performed by guiding the beam reflected from the reflection surface 207 into the inside of the PD block 205. Meanwhile, the light receiving surface 206 is light-shielded by the end surface of the reflection surface 207, and through this configuration, the scattering light, generated when an ink droplet collides with the beam, can be detected.

In such a configuration, for example, the output of scattering light from all the nozzle rows can be stably detected when the diameter of the beam on the reflection surface 207 is about 0.1 mm, and a distance between the center and the end surface is 0.4 mm. Accordingly, this state needs to be maintained also in the state of being built in the main body. However, the task of this is how to suppress the distortion occurring at the time of mounting, in a case where the above-described module base 108 has the metal-plate chassis structure described above, and the fastening position thereof becomes important.

In FIG. 3, the fastening member 110 is disposed at one position on the light receiving unit 105 side. At this time, in a case where there is an abnormality such that a distortion θ occurs when mounting the module base to the mounting face 109*a*, the light receiving surface 206 is influenced as inclination β. However, a distance Xa up to the fastening unit is short, and thus the amount of the position misalignment is such an extent as not to influence the detection capability. In addition, since the light emitting unit is separated therefrom by a distance Xb, the effect of the distortion on the light emitting unit 104 is not much.

Figure 4:
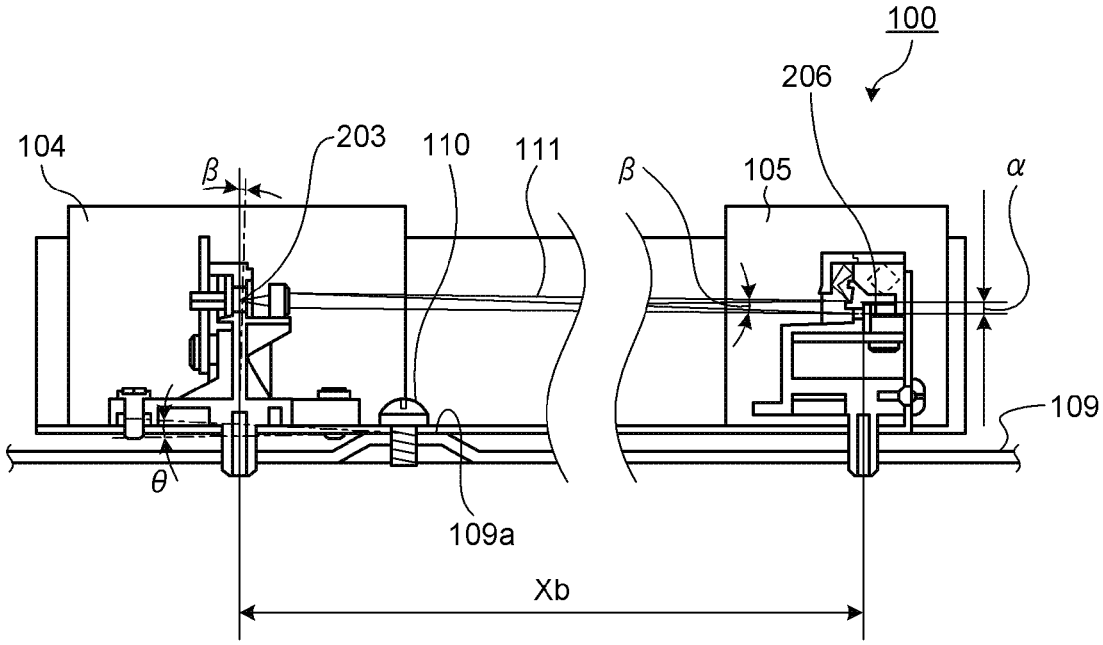
FIG. 4 is an explanatory diagram illustrating the configuration of a light emitting unit and a light receiving unit and illustrating an example in which a fastening member is disposed at one position on the light emitting unit side.

FIG. 4 is an explanatory diagram illustrating the configuration of the light emitting unit 104 and the light receiving unit 105 and illustrating an example in which the fastening member 110 is disposed at one position on the light emitting unit 104 side. In FIG. 4, in a case where there is an abnormality such that a distortion θ occurs when mounting the module base onto the mounting face 109*a*, the inclination of the light emitting point 203 is β, and the detection beam 111 also inclines by the inclination β. In addition, at the leading end of the detection beam 111, since the distance Xb is long, the amount α of beam inclination is created. In this example, the detection beam 111 enters up to the light receiving surface 206 due to the amount α of inclination of the beam, rendering the scattering light undetectable.

An approximate calculation of the amount α of inclination of the beam is as below. The distortion of the fastening unit of 0.05 mm is increased up to 1 mm at the light receiving position based on "beam inclination amount α=distortion θ×distance Xb/fastening unit diameter (–=0.05×200/10=1)" when the distortion θ of 0.05 mm occurs with the diameter of the fastening unit=ϕ10 mm, and a distance from the light emitting point 203 to the light receiving surface 206 Xb=200 mm.

Accordingly, it can be said that a fastening arrangement is more effective in an arrangement where the fastening position gets closer to the light receiving unit 105 side shown FIG. 3 than in an arrangement where a fastening position is near the center as shown FIG. 1. Because the configuration does not likely to give the influence of the distortion to both side of the light emitting unit 104 and the light receiving unit 105 disposed on both sides.

Figure 5:
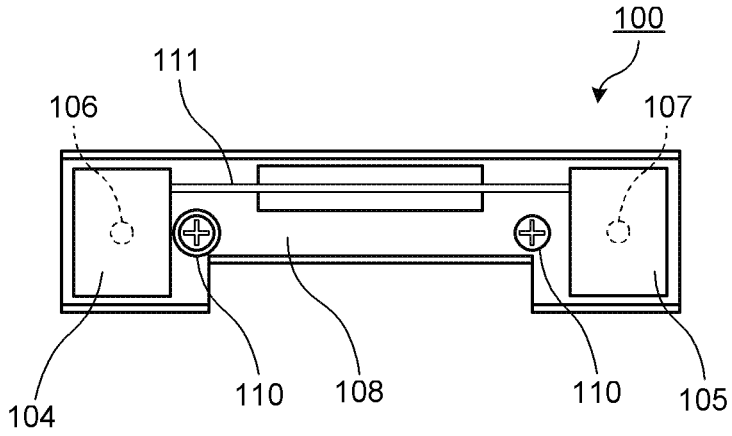
FIG. 5 is a plan view illustrating a fastening method in which an elastic member is arranged in the configuration of FIG. 3.
Figure 6:
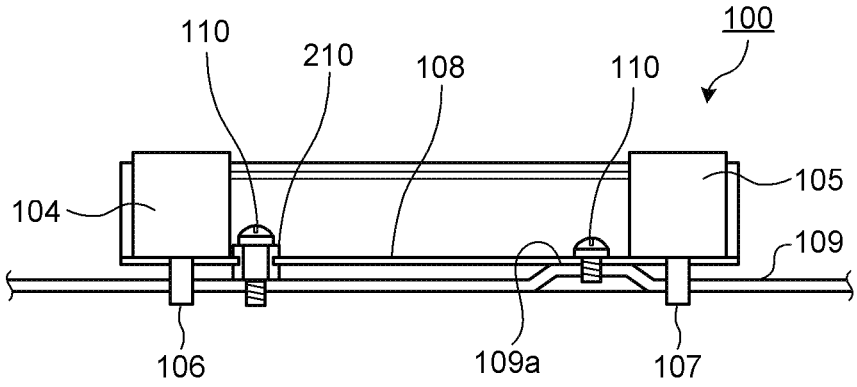
FIG. 6 is a side view illustrating a fastening method in which an elastic member is arranged in the configuration of FIG. 3.

However, in the configuration of FIG. 3, a case is considered in which the detection range is long and there is a problem in the stability of the maintenance of the fastening due to the weight balance of the ink detecting module 100 or the like. A configuration example addressing such as case is illustrated in FIGS. 5 and 6. In the configuration as illustrated in FIGS. 5 and 6, by fastening the fastening member 110 through an elastic member 210 to the light emitting unit 104 side, the stability of the maintenance can be achieved while suppressing the distortion due to the fastening to be minimal. In addition, all the fastening units may be fastened through buffer members.

As described above, the light emitting unit 104 and the light receiving unit 105 are integrated with the module base 108 and the optical axes thereof are adjusted with respect to the positioning pins 106 and 107. Then, the module base 108 is disposed in portions of the mounting base 109 that correspond to the positioning pins 106 and 107 and thereafter is configured so as to be screw-fastened at one position on the mounting face 109*a* by the fastening member 110. Accordingly, the distortion of the module base 108 at the time of fastening can be reduced to be minimal. In addition, since it is possible to suppress the occurrence of the deviation of the optical axes in the state where the optical axes are adjusted while the module base being mounted on the main body, it is possible to improve the assembly capability and the stability of the detection capability and to provide a low-cost base structure.

In addition, by setting the above-described fastening position to a position near the center of the ink detecting module 100 or to a position near to the light receiving unit 105, the influence of the distortion caused by the fastening of the light emitting unit 104 on the light emitting point 203 can be reduced; and the occurrence of the deviation of optical axes in the state where the optical axes have been adjusted in the detection state while the module base being mounted on the main body can be reduced, whereby it is possible to improve the assembly capability and the stability of the detection capability and to provide a low-cost base fastening configuration.

In addition, by fastening through the elastic member 210 located at least at one position in a gap portion between the ink detecting module 100 and the mounting base 109 other than the fastening unit, the stability of the detection can be maintained even when the detection length is long, and accordingly, a long printing head can become also applicable.

In addition, in a configuration where the optical axes of the light emitting device and the light receiving device are offset and where the scattering light is detected thereby, the deviation of the optical axes gives high influence over the detection capability. In the case of such a detection configuration, especially, by employing a technique of this embodiment that is capable of reducing the distortion of the module base 108 at the time of fastening to be minimal, it is possible to improve the assembly capability and the stability of the detection capability, and to provide a low-cost base structure. In addition, by mounting the droplet detecting device (for example, the configuration of FIG. 1 or 5) represented by this embodiment into an inkjet printer, it is possible to provide a low-cost inkjet printer having stable printing capability.

INDUSTRIAL APPLICABILITY

As described above, a droplet detecting device and an inkjet printer according to the present invention are useful for a droplet detecting device and an inkjet printer that detect the discharge of liquid droplets from a nozzle and, particularly, are suitable for a device or a system in which a light emitting device and a light receiving device are integrally mounted on a main body through adjustment of the optical axes thereof.

REFERENCE SIGNS LIST

100 INK DETECTING MODULE
101 CARRIAGE
102 RECORDING HEAD
103 NOZZLE ROW
104 LIGHT EMITTING UNIT
105 LIGHT RECEIVING UNIT
106, 107 POSITIONING PINS
108 MODULE BASE
109 MOUNTING BASE
109*a* MOUNTING FACE
110 FASTENING MEMBER
111 DETECTION BEAM
210 ELASTIC MEMBER

The invention claimed is:

1. A droplet detecting device that detects a discharge state of a liquid droplet by receiving a light beam emitted to a flying path of the liquid droplet discharged from a nozzle of an inkjet printer, the droplet detecting device comprising a detection unit, the detection unit including:

a light emitting unit that emits the light beam;

a light receiving unit that receives the emitted light beam; and a base unit integrally supporting the light emitting unit and the light receiving unit, wherein the base unit includes:

at least two positioning units that are engaged with a mounting base of the inkjet printer and determine a fastening position of the detection unit onto the inkjet printer; and a first fastening unit that fastens the base unit to the mounting base of the inkjet printer, and wherein, in the state of the detection unit being fastened to the inkjet printer, only the positioning units and the first fastening unit are in contact with the mounting base of the inkjet printer.

2. The droplet detecting device of claim 1, wherein the first fastening unit is arranged at an approximate center of the detection unit, or at a position close to the light receiving unit from the center.

3. The droplet detecting device of claim 1, wherein the light receiving unit receives scattering light that is generated when the light beam collides with the liquid droplet, and the detection unit detects the discharge state of the liquid droplet based on light intensity of the scattering light.

4. An inkjet printer in which the droplet detecting device according to claim 1 is built.

5. A droplet detecting device that detects a discharge state of a liquid droplet by receiving a light beam emitted to a flying path of the liquid droplet discharged from a nozzle of an inkjet printer, the droplet detecting device comprising a detection unit, the detection unit including:

a light emitting unit that emits the light beam;

a light receiving unit that receives the emitted light beam; and a base unit integrally supporting the light emitting unit and the light receiving unit, wherein the base unit includes:

at least two positioning units that are engaged with a mounting base of the inkjet printer and determine a fastening position of the detection unit onto the inkjet printer;

a first fastening unit that fastens the base unit to the mounting base of the inkjet printer; and a second fastening unit that fastens the base unit to the mounting base of the inkjet printer through an elastic member, wherein, in the state of the detection unit being fastened to the inkjet printer, only the positioning units and the first and second fastening units are in contact with the mounting base of the inkjet printer.

* * * * *